United States Patent [19]

Burt

[11] 4,030,140

[45] June 21, 1977

[54] HARD SAFETY HAT

[76] Inventor: Terry L. Burt, 5169 Highland Drive, Marrero, La. 70072

[22] Filed: Aug. 9, 1976

[21] Appl. No.: 712,434

[52] U.S. Cl. ..... 2/410; 2/10

[51] Int. Cl.[2] ..... A42B 3/02

[58] Field of Search ..... D2/231, 232; 2/10, 410, 2/412, 413, 414

[56] References Cited

UNITED STATES PATENTS

| | | | |
|---|---|---|---|
| 2,926,356 | 3/1960 | Taylor | D2/231 X |
| 3,239,842 | 3/1966 | Marchello | 2/10 X |
| 3,703,750 | 11/1972 | Irwin | 2/10 X |
| 3,781,915 | 1/1974 | Menold et al. | 2/10 |
| D228,264 | 9/1973 | Potter | D2/231 |
| D235,938 | 7/1975 | Lindblom | D2/231 |

*Primary Examiner*—Alfred R. Guest
*Attorney, Agent, or Firm*—James B. Lake, Jr.

[57] ABSTRACT

A hard hat in which the bill has been moved upward on the hat to define a space therebelow that is contoured to hold face protective gear in its normal shape when not in use by the wearer of the hard hat. A forward part of a fore and aft extending reinforcing projection defines a finger hold thereon.

2 Claims, 2 Drawing Figures

HARD SAFETY HAT

BACKGROUND OF THE INVENTION

The invention relates generally to hats with bills and crowns, and more particularly to hard safety hats having bills raised on associated crowns to define thereunder spaces contoured to unstressinly engage facial protective gear when not in use.

The prior art teaches hard hats with a bill projecting forwardly from a rim of an associated crown for protecting the eyes of a wearer, with the crown thereabove defining a center reinforcing projection extending across the hat from brim bill to a back rim to taper into each. Reference is made to Menold et al, U.S. Pat. No. 3,781,915; McMurry, U.S. Pat. No. Des. 180,238; Potter, U.S. Pat. No. Des. 228,264; Zuppert, U.S. Pat. No. Des. 234,411; Lindblom, U.S. Pat. No. Des. 235,938; and Peham, U.S. Pat. No. Des. 210,648.

SUMMARY OF THE INVENTION

It is an object of the invention to provide a hard safety hat with a bill that not only protects the wearer's eyes but also his facial protective gear when not in use and improves his angle of vision at all times.

Another object of the invention is to provide finger holds for removing and replacing the hat that precludes touching the facial protective gear engaged thereon.

Still another object of the invention is to provide a smoothly contoured surface under a bill for engaging facial protective gear without deformation across a reinforcing projection.

DETAILED DESCRIPTION OF THE INVENTION

Figure 1:
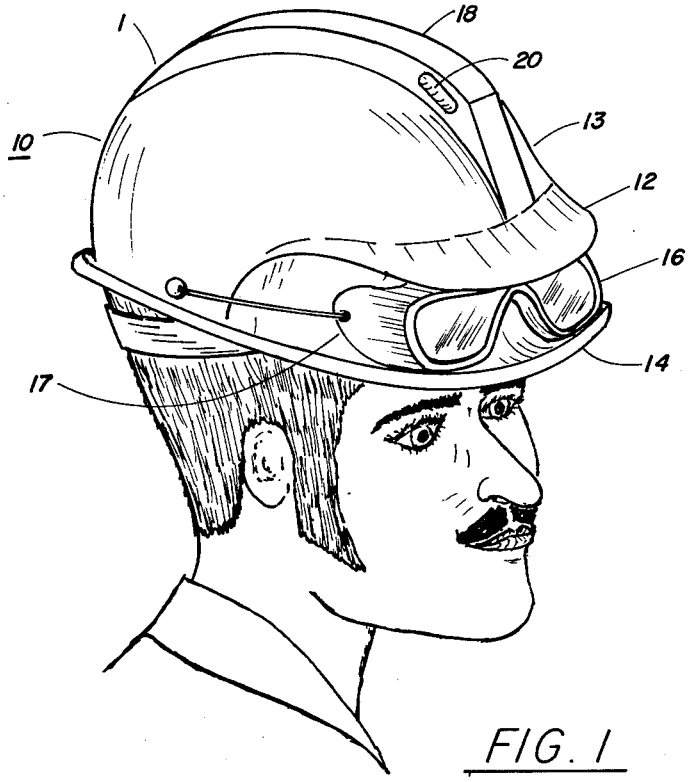
FIG. 1 is a three dimensional, three-quarter view of the invention and a wearer.
Figure 2:
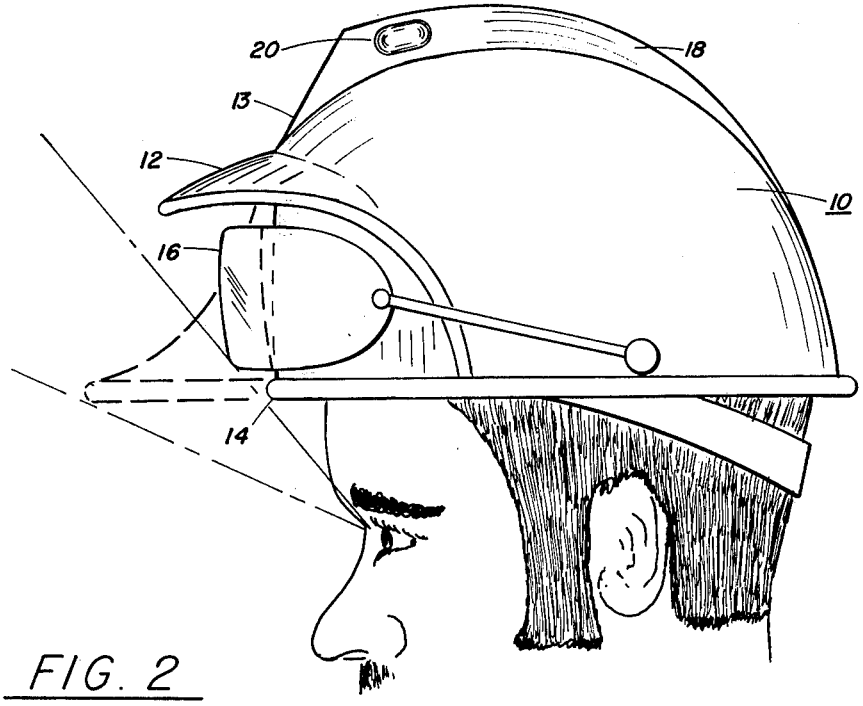
FIG. 2 is a side elevation of the invention and a wearer.

Referring to FIGS. 1 and 2, the invention comprises a hard hat 10 having a bill 12 projecting from a crown 13 at least a distance above a lower brim 14 of hat 10 sufficiently to receive therebetween protective goggles 16. Brim 14 below bill 12 is contoured to conform to the normal shape of the facially engaging surfaces 17 of goggles 16 for preventing the goggles from being stressed out of shape over a reinforcing projection 18, and thus in a short time becoming inadequate or useless for protecting the eyes and face of a wearer. Bill 12 protects goggles 16 as well as the wearer's face from noxious chemical liquid drips often encountered in places of manufacture. The reinforcing projection 18 is recessed to define finger holds 20 for removing and replacing hat 10 without touching goggles 16.

In use, the wearer's angle of vision is considerably increased with the raised bill as shown by the dotted lines in FIG. 2, and the speed with which the use of the goggles can be discontinued and resumed is considerably increased.

The hat can also be used for workers wearing respirators, filters or other facial protective devices with equal benefit in providing a non-deforming, smoothly contoured surface for engaging the devices when not in use. In both cases the use of the devices can be discontinued or resumed with greater speed and facility than with the lower bill.

What is claimed is:

1. A hard safety hat, having a crown, for workers wearing safety gogles, comprising:

a. a brim defined by a lower portion of said crown;

b. a bill mounted forwardly on said crown and above said brim defining a spacing therebetween sufficient to accomodate the height of said gogles and constitute a support thereof when not in use.

2. A hard safety hat as described in claim 1 wherein said spacing is smoothly contoured to fit said safety gogles for maintaining the fitting to the wearer.

* * * * *